US008382101B2

(12) United States Patent
Ishioka

(10) Patent No.: US 8,382,101 B2
(45) Date of Patent: Feb. 26, 2013

(54) SHEET CONVEYING APPARATUS AND IMAGE FORMING APPARATUS

(75) Inventor: Naoki Ishioka, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 48 days.

(21) Appl. No.: 13/076,689

(22) Filed: Mar. 31, 2011

(65) Prior Publication Data

US 2011/0204561 A1 Aug. 25, 2011

Related U.S. Application Data

(62) Division of application No. 12/399,334, filed on Mar. 6, 2009, now Pat. No. 7,942,411.

(30) Foreign Application Priority Data

Mar. 27, 2008 (JP) ..... 2008-083854

(51) Int. Cl.
*B65H 9/04* (2006.01)

(52) U.S. Cl. ..... 271/243; 271/272

(58) Field of Classification Search ..... 271/272, 271/274, 264, 243
See application file for complete search history.

(56) References Cited

U.S. PATENT DOCUMENTS

2007/0069456 A1* 3/2007 Jeong ..... 271/272

FOREIGN PATENT DOCUMENTS

| | | |
|---|---|---|
| JP | 57-146134 UA | 9/1982 |
| JP | 01-207777 A | 8/1989 |
| JP | 2003-128306 | 5/2003 |

* cited by examiner

*Primary Examiner* — Kaitlin Joerger
(74) *Attorney, Agent, or Firm* — Fitzpatrick, Cella, Harper & Scinto

(57) ABSTRACT

A sheet conveying apparatus has a guide member disposed in a space on a side of a pair of rotating bodies. The guide member is supported such that the guide member can project outward from an outer periphery of one of the rotating bodies located upstream in a sheet conveying direction. When a front end of a conveyed sheet abuts against the guide member and pushes the guide member, the guide member retracts from a projecting position into the space on the side of the pair of rotating bodies, and in this state, the front end of the sheet is guided to a nip portion of the pair of rotating bodies.

6 Claims, 11 Drawing Sheets

SHEET CONVEYING APPARATUS AND IMAGE FORMING APPARATUS

This application is a divisional of U.S. patent application Ser. No. 12/399,334, filed Mar. 6, 2009 now U.S. Pat. No. 7,942,411, and allowed Feb. 4, 2011.

BACKGROUND OF THE INVENTION

1. Field of the Invention

The present invention relates to a sheet conveying apparatus which nips a sheet by a pair of conveying rollers and conveys the sheet, and to an image forming apparatus having the sheet conveying apparatus.

2. Description of the Related Art

A conventional image forming apparatus such as a copying machine, a printer and a multifunction machine includes a sheet conveying apparatus which nips a sheet using a pair of conveying rollers and conveys the sheet as a system which conveys a sheet. An electrophotographic system is widely used in image forming apparatuses. The image forming apparatus of the electrophotographic system conveys a sheet after toner is transferred to the sheet to a fixing portion, applies heat and pressure to the sheet, and the toner image transferred to the sheet is fixed. Since heat and pressure is applied to a sheet which passed through the fixing portion, a shrinkage difference is generated on the front and the back of the sheet due to a difference in a moisture amount on the front and the back of the sheet or a difference in a toner amount on the front and the back of the sheet, and the sheet is curled in some cases.

Users require various functions from the image forming apparatuses, and in two-sided image formation, it is required to form an image on the front and the back of the sheet without misregistration. However, due to heat, the outside shape of a sheet which once passed through the fixing portion is changed and thus, in order to form an image without misregistration, it is necessary to precisely measure the outside shape of a sheet which passed through the fixing portion, and this is reflected to an image forming position when an image is formed.

FIG. 10 illustrates a conventional image forming apparatus having a sheet conveying apparatus provided downstream of a fixing portion.

As illustrated in FIG. 10, the sheet conveying apparatus includes a sensor portion 82 which measures a length of a sheet in the conveying direction so as to measure the length of the sheet after it passes through the fixing portion. The sheet conveying apparatus includes a pair of conveying rollers comprising a drive-side blast roller 80 and a follower-side rubber roller 81. The blast roller 80 is formed by subjecting a metal roller surface to blast processing. By conveying a sheet under high conveying force between the blast roller 80 subjected to processing to increase the friction coefficient and the rubber roller 81, slip is suppressed and conveying operation of a sheet is stabilized. Therefore, a sensor portion 82 detects a front end position and a rear end position of a sheet conveyed by the rollers 80 and 81, but since the rollers 80 and 81 prevent the sheet from slipping, it is possible to precisely measure a length of the sheet in the conveying direction.

According to the pair of conveying rollers using the blast roller 80 having high surface friction coefficient, if a sheet having a curled front end is conveyed and abuts against the blast roller 80, there is an adverse possibility that the front end of the sheet is caught and the front end is crushed, bent or ripped. Hence, it is proposed to provide a guide member which smoothly guides a front end of a sheet to a nip portion between the blast roller 80 and the rubber roller 81. This technique is disclosed in Japanese Patent Application Laid-open No. 2003-128306.

FIG. 11 illustrates one example of a conveying roller mechanism provided with a conventional guide member. As illustrated in FIG. 11, the conveying roller mechanism, includes a pair of conveying rollers 71 and 72 having a friction force required for transmitting a conveying force to a sheet S, and a ring member 70 having an outer diameter larger than that of the conveying roller 71 and having an outer peripheral surface of low friction coefficient. A plurality of conveying rollers 71 are disposed in the axial direction such that the conveying roller 72 and the ring member 70 alternately come into contact with the conveying rollers 71 in the axial direction.

With this structure, the ring member 70 functions as the guide member, a front end of a sheet is guided along a peripheral surface of the ring member 70, and the front end of the sheet can reliably be guided to a nip portion (pressure contact portion) between the pair of conveying rollers 71 and 72. Therefore, since the front end of the sheet does not hit the conveying roller 71 having high friction coefficient, it is possible to prevent the front end of the sheet from being crushed, folded or ripped.

However, the ring member 70 illustrated in FIG. 11 is in contact with the conveying roller 72 having high friction coefficient. Since the friction coefficient of the ring member 70 is lower than those of the pair of conveying rollers 71 and 72, a conveying force for nipping and conveying the sheet by the ring member 70 and the conveying roller 72 is smaller than a conveying force for nipping and conveying the sheet by the pair of conveying rollers 71 and 72. Thus, locations having different conveying forces are generated in the axial direction of the pair of conveying rollers, and there is an adverse possibility that the sheet is fed on the skew or creased.

A peripheral surface of the ring member 70 is shaved by the conveying roller 72 having high friction coefficient at the time of contact, and since the peripheral surface of the ring member 70 is shaved, the friction resistance of the peripheral surface is increased or the outer diameter of the ring member 70 is reduced. If the friction resistance of the peripheral surface of the ring member 70 is increased or the outer diameter is reduced, the guiding function of the ring member 70 is deteriorated. That is, there is a possibility that a front end of a sheet can not reliably be guided to the nip portion between the rollers 71 and 72, the front end of the sheet is caught on the peripheral surface of the ring member 70, and the front end of the sheet is folded, bent or ripped.

SUMMARY OF THE INVENTION

Hence, the present invention has been accomplished in view of the above circumstances, and it is an object of the invention to provide a sheet conveying apparatus and an image forming apparatus capable of preventing a front end of a sheet from being folded, bent or ripped on an outer periphery of a roller.

A sheet conveying apparatus of the present invention comprises; a pair of rotating bodies which nip a sheet by a nip portion and convey the sheet; and a guide member disposed in a space on a side of the pair of rotating bodies, wherein the guide member is supported such that the guide member can project outward from an outer periphery of one of the rotating bodies located upstream in a sheet conveying direction, and when a front end of a conveyed sheet abuts against the guide member and pushes the guide member, the guide member retracts from a projecting position into the space on the side of the pair of rotating bodies.

Further features of the present invention will become apparent from the following description of exemplary embodiments (with reference to the attached drawings).

DESCRIPTION OF THE PREFERRED EMBODIMENT

The best mode for carrying out the present invention will be described in detail with reference to the drawings.

[First Embodiment]

Figure 1:
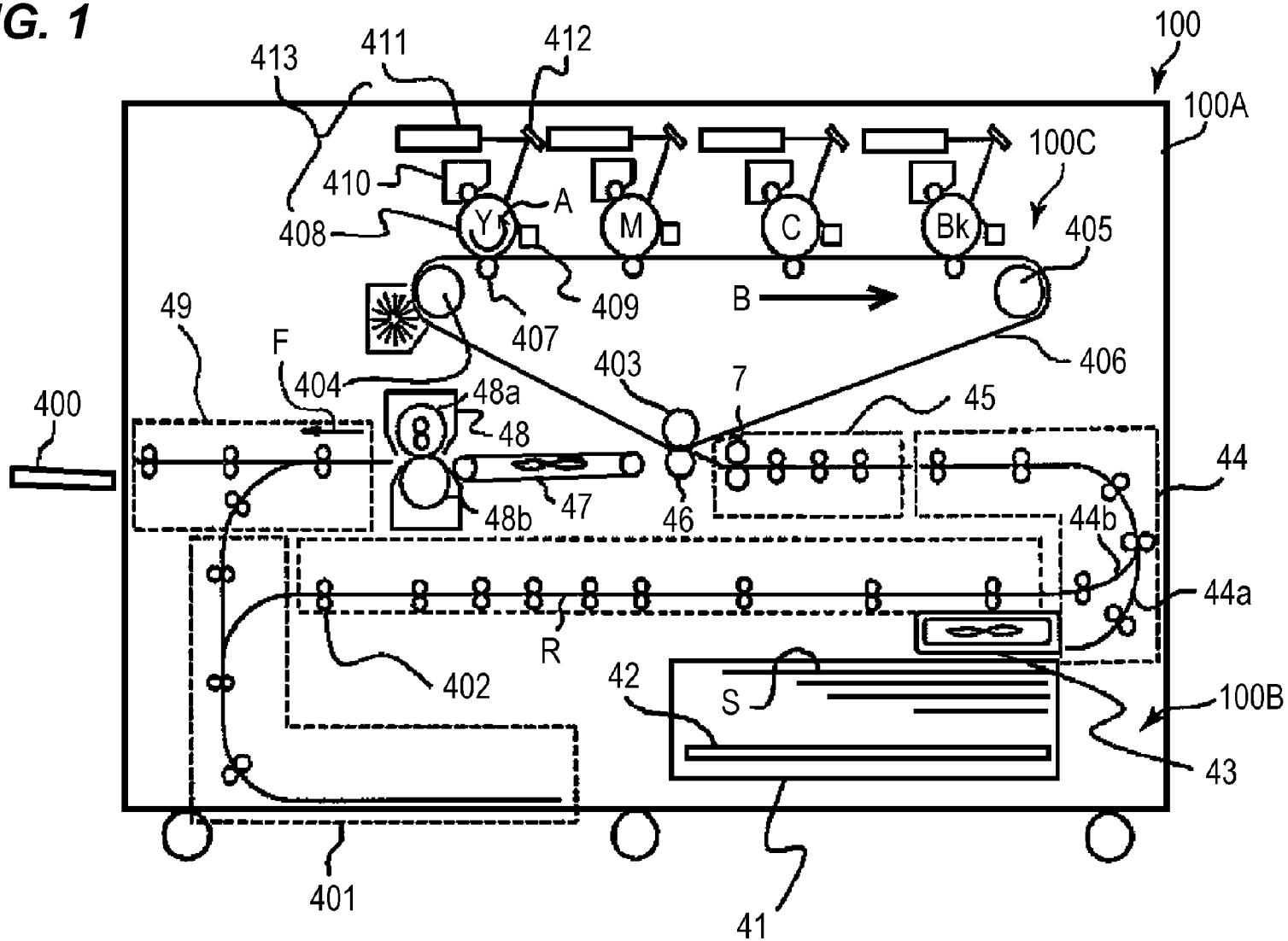
FIG. 1 illustrates a brief structure of a color image forming apparatus which is one example of an image forming apparatus having a sheet conveying apparatus according to a first embodiment of the present invention.
Figure 2:
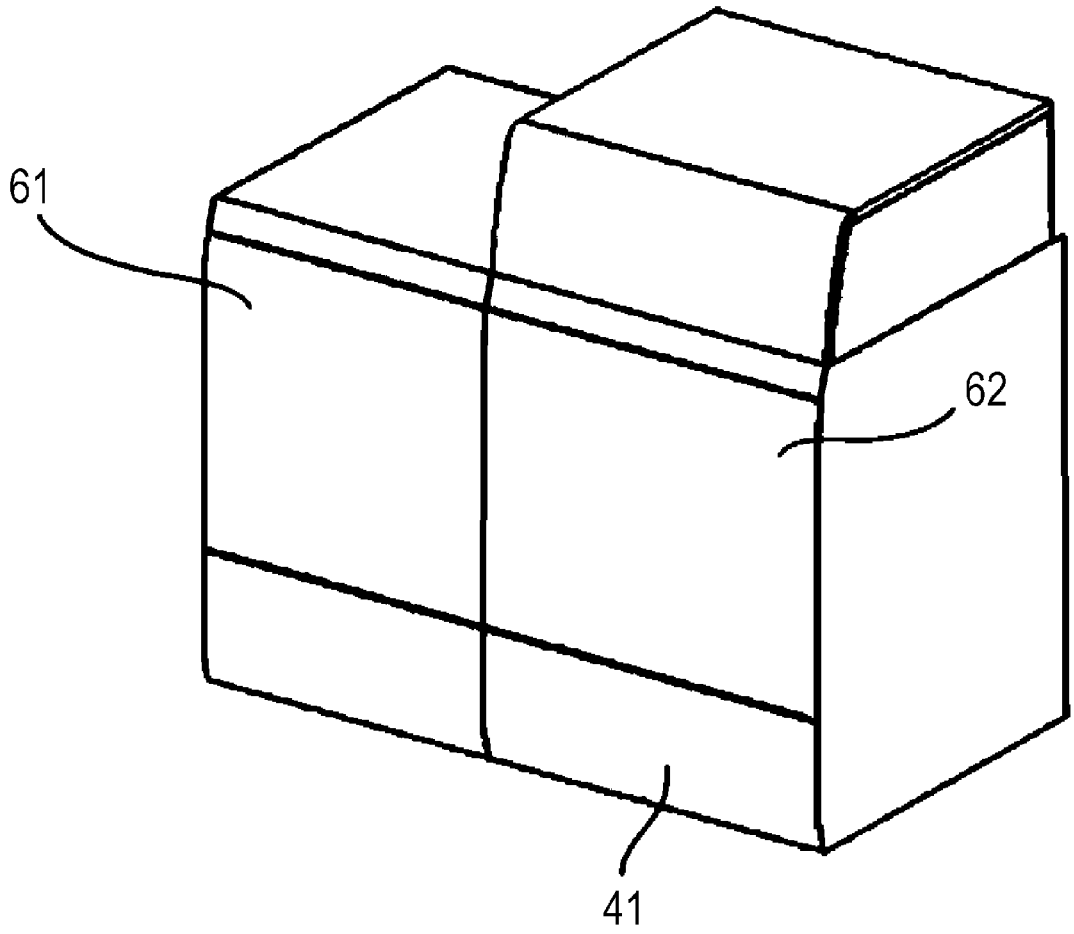
FIG. 2 is a perspective view of the image forming apparatus.

FIG. 1 illustrates a brief structure of a color image forming apparatus which is one example of an image forming apparatus having a sheet conveying apparatus according to a first embodiment of the present invention. FIG. 2 is a perspective view of the image forming apparatus.

FIG. 1 illustrates a color image forming apparatus 100 and a color image forming apparatus body 100A (apparatus body, hereinafter). In FIG. 2, a front surface of the apparatus body 100A of the image forming apparatus 100 is covered with double door type front covers 61 and 62. A sheet storage portion 41 is disposed at a lower portion of the apparatus body 100A, and the sheet storage portion 41 can be pulled out in the front surface direction. The color image forming apparatus can be classified, based on structures, into a tandem type in which a plurality of image forming portions are arranged side by side, and a rotary type in which the plurality of image forming portions are disposed cylindrically. The transfer method can be classified into a directly transfer type in which a toner image is transferred from a photosensitive drum directly to a sheet, and an intermediate transfer type in which a toner image is once transferred to an intermediate transfer member and then, the toner image is transferred to a sheet.

According to the intermediate transfer type, since it is unnecessary to hold a sheet on a transfer unit unlike the direct transfer type, various kinds of sheets such as extremely thick paper and coated paper can be used. Further, the image forming processing can be carried out in parallel by the plurality of image forming portion and a full color image can be transferred in batch processing and thus, the intermediate transfer type is suitable for enhancing productivity. The color image forming apparatus 100 of the first embodiment is of the intermediate transfer tandem type in which four color image forming units are arranged on an intermediate transfer belt side by side.

As illustrated in FIG. 1, the apparatus body 100A includes an image forming portion 413, a sheet feeding apparatus 100B which conveys a sheet S, and a transfer portion 100C which transfers a toner image formed by the image forming portion 413 to the sheet S fed by the sheet feeding apparatus 100B. The apparatus body 100A includes a fixing portion 48 which fixes a toner image formed by the image forming portion 413 onto a sheet S. The apparatus body 100A further includes a conveying unit 44, a skew feeding correcting apparatus 45 having a registration roller 7, a pre-fixing conveying portion 47, a sheet conveying apparatus 49, a flip-over conveying apparatus 401, and a double-side conveying apparatus 402. The skew feeding correcting apparatus 45 is disposed downstream from the conveying unit 44 in the sheet conveying direction, and upstream of the transfer portion 100C in the sheet conveying direction. The sheet conveying apparatus 49 is disposed downstream of the fixing portion 48 in the sheet conveying direction.

The image forming portion 413 includes image forming units of yellow (Y), magenta (M), cyan (C) and black (Bk) each including a photosensitive drum 408, an exposure apparatus 411, a development device 410, a primary transfer apparatus 407 and a cleaner 409. Colors formed by these image forming units are not limited to these four colors, and the alignment of the colors is not limited to this neither.

The sheet feeding apparatus 100B includes a sheet storage portion 41 which stores sheets S in such a form that the sheets S are stacked on a lift up apparatus 42, and a sheet feeding portion 43 which feeds sheets S stored in the sheet storage portion 41. The sheet feeding portion 43 may employ a system which utilizes friction separation by a sheet feeding roller and a system which utilizes separation and adsorption by air. In the first embodiment, a sheet feeding method utilizing air is employed.

The transfer portion 100C is stretched by rollers such as a driving roller 404, a tension roller 405 and a secondary transfer inner roller 403. The transfer portion 100C includes an intermediate transfer belt 406 which is conveyed and driven in the direction of the arrow B in the drawing.

The intermediate transfer belt 406 transfers a toner image formed on the photosensitive drum 408 by predetermined pressurizing force and electrostatic load bias applied from the primary transfer apparatus 407. The intermediate transfer belt 406 absorbs a non-fixed image on a sheet S by applying the predetermined pressurizing force and electrostatic load bias in the secondary transfer portion formed by substantially opposed secondary transfer inner roller 403 and secondary transfer outer roller 46.

The fixing portion 48 includes a heating roller 48*a* and a pressurizing roller 48*b* which comes into contact with the heating roller 48*a* under pressure.

In the color image forming apparatus 100 having such a structure, when an image is to be formed, the photosensitive drum 408 is first rotated in the direction of the arrow A in the drawing, and a surface of the photosensitive drum 408 is previously uniformly charged by a charging portion (not illustrated).

Thereafter, the exposure apparatus 411 emits light based on a sent signal of image information to the rotating photosensitive drum 408, the photosensitive drum 408 is irradiated with this light through a reflection minor 412, and a latent image is formed. Transfer remaining toner which slightly remains on the photosensitive drum 408 is collected by the cleaner 409 in preparation for next image forming operation.

Next, toner development is carried out the development device 410 for an electrostatic latent image formed on the photosensitive drum 408, and a toner image is formed on the photosensitive drum 408. Thereafter, a predetermined pressurizing force and electrostatic load bias are given by the primary transfer apparatus 407, and the toner image is transferred onto the intermediate transfer belt 406.

An image is formed by the image forming units of Y, M, C and Bk of the image forming portion 413 at the moment when a primarily transferred upstream toner image is superposed on the intermediate transfer belt 406. As a result, a full color toner image is formed in the intermediate transfer belt 406 eventually.

A sheet S is fed out by the sheet feeding portion 43 at the moment when an image is formed by the image forming portion 413. Thereafter, the sheet S passes through a conveying path 44*a* provided in the conveying unit 44, and is fed to the skew feeding correcting apparatus 45 to correct the misregistration and skew feeding of the conveyed sheet S.

The skew feeding correcting apparatus 45 corrects the misregistration and skew feeding of a sheet S. A timing correction of the sheet S is made by the pair of registration rollers and then, the sheet S is conveyed to a secondary transfer portion formed by the secondary transfer inner roller 403 and the secondary transfer outer roller 46. Thereafter, a full color toner image is secondary transferred onto a sheet S in the secondary transfer portion.

Next, the sheet S on which the toner image is secondary transferred is conveyed to the fixing portion 48 by the prefixing conveying portion 47. In the fixing portion 48, heat and pressure are applied by substantially opposed rollers 48*a* and 48*b*, and toner is melted and fixed onto a sheet S.

Next, the sheet S having the fixed image obtained in this manner is discharged onto a sheet-discharge tray 400 as it is by the sheet conveying apparatus 49. When images are to be formed on both sides of a sheet, the sheet is conveyed to the flip-over conveying apparatus 401 by switching of a switching member (not illustrated).

When the sheet is conveyed to the flip-over conveying apparatus 401, a front end and a rear end of the sheet S are switched by switching back operation, and the sheet S is conveyed to a re-conveying path R provided in the double-side conveying apparatus 402. Thereafter, the path merges with a re-feeding path 44*b* of the conveying unit 44 at the right time with a subsequent job sheet S conveyed from the sheet feeding apparatus 100B, and the sheet is sent to a secondary transfer portion. Since the image forming process is the same as the first process, description thereof will be omitted.

A large number of conveying rollers are disposed in the conveying unit 44, the sheet conveying apparatus 49, the flip-over conveying apparatus 401 and the double-side conveying apparatus 402. In these conveying rollers, the driving roller and the follower roller rotate in a state where a sheet S is nipped between the driving roller and the follower roller and with this, the sheet S is conveyed. These conveying rollers apply a force to the follower roller toward the driving roller by a biasing member such as a spring (not illustrated), thereby setting a pressure of nipping a sheet S between the rollers.

Heat and pressure are applied to a sheet S which passed through the fixing portion 48 by the fixing portion 48, the sheet S is shrunk and a length thereof in the conveying direction (in the direction of the arrow F) is changed.

Hence, in the first embodiment, when images are to be formed on both sides of the sheet S, the length of the sheet S after it passed through the fixing portion 48 is measured to form imaged on the front and the back without misregistration.

Figure 3:
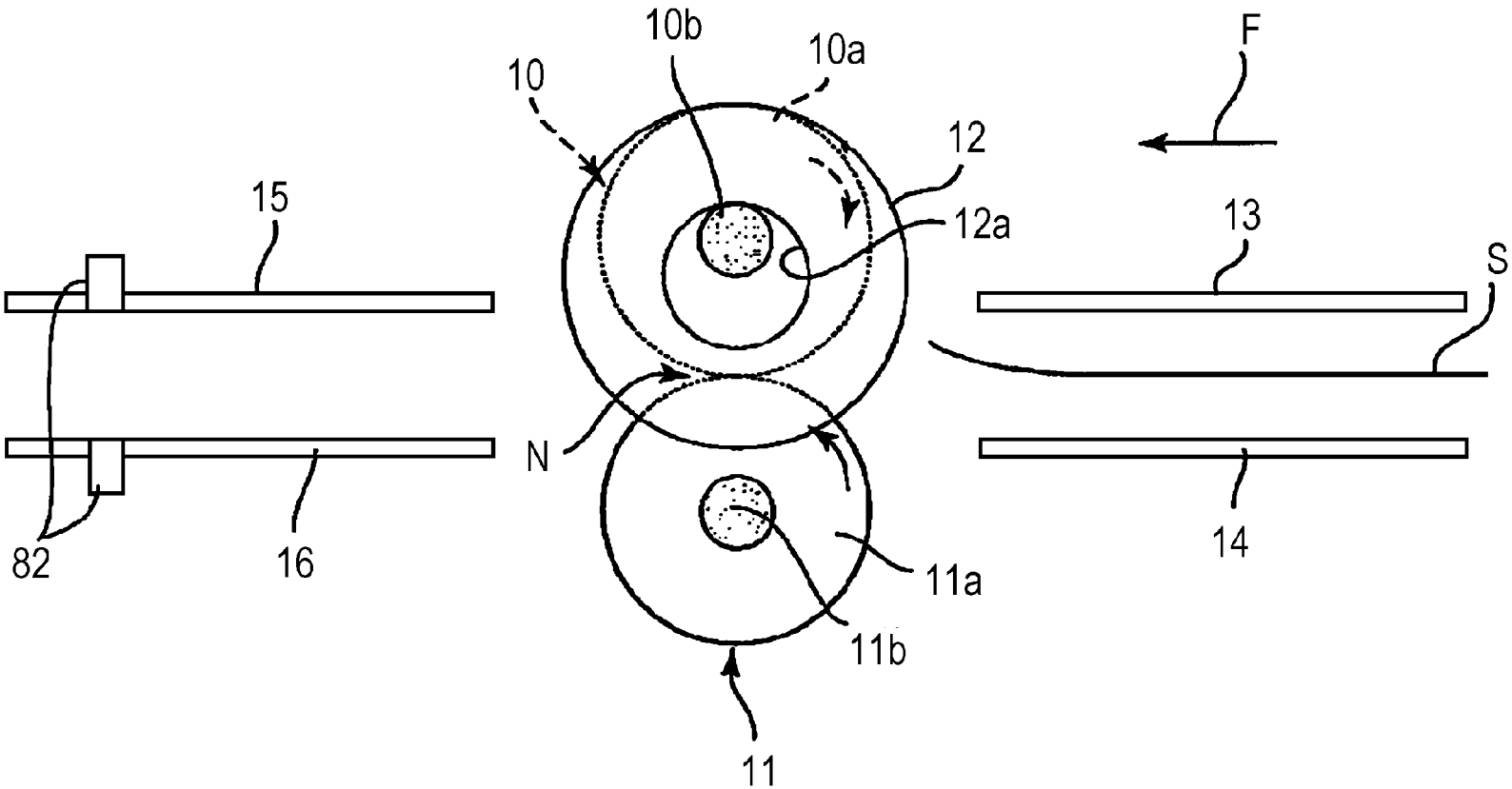
FIG. 3 is an explanatory diagram illustrating an essential portion of the sheet conveying apparatus.
Figure 4:
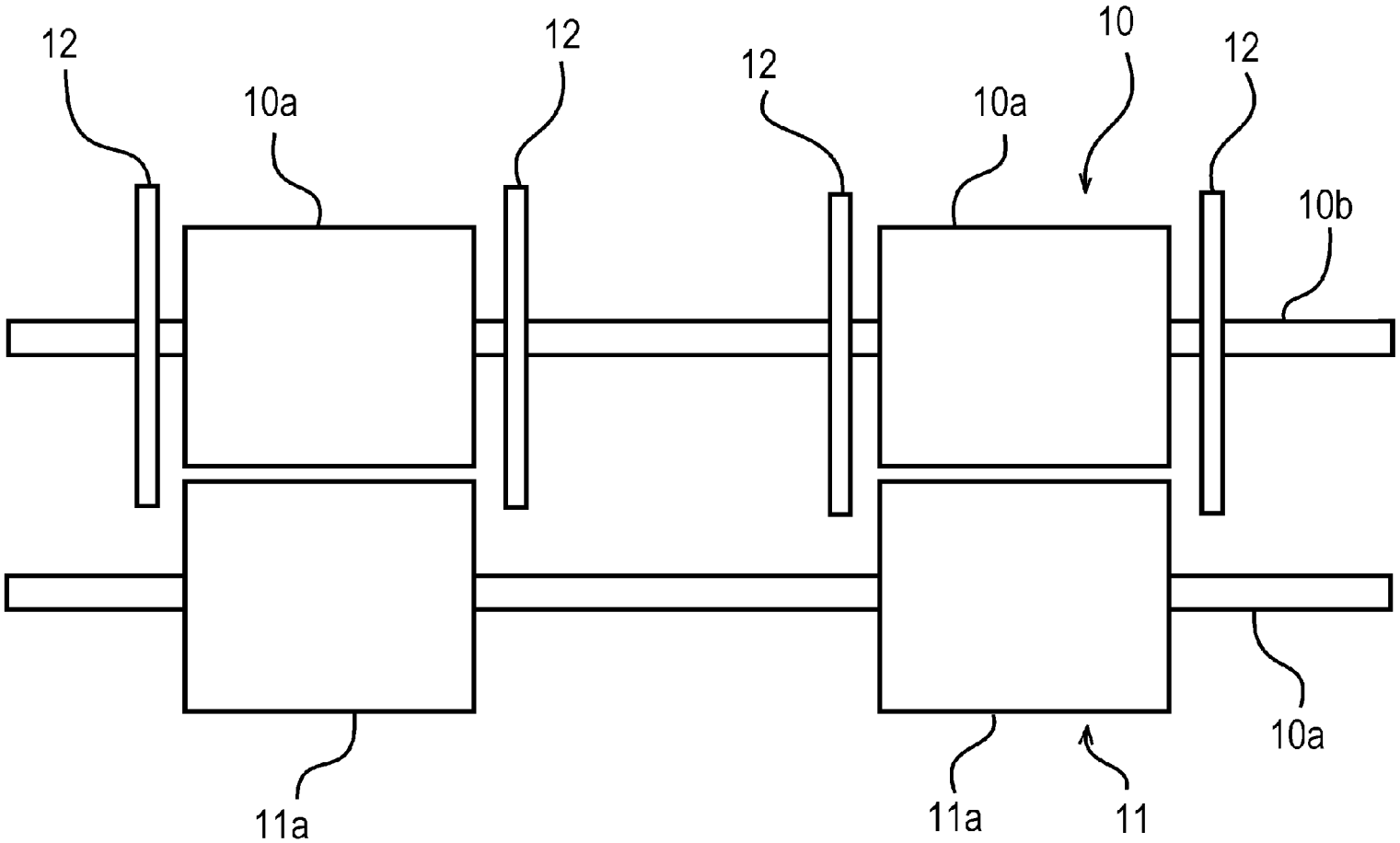
FIG. 4 is an explanatory diagram illustrating an essential portion of the sheet conveying apparatus as viewed from a conveying direction of a sheet.

FIG. 3 is an explanatory diagram illustrating an essential portion of the sheet conveying apparatus. FIG. 4 is an explanatory diagram illustrating the sheet conveying apparatus as viewed from a conveying direction of a sheet. As illustrated in FIG. 3, the sheet conveying apparatus 49 includes a pair of conveying rollers 10 and 11, and a sensor portions 82 and 82 which measure a length of a sheet S in the sheet conveying direction after it passed through the fixing portion 48. The sensor portions 82 and 82 are disposed in a pair of downstream conveying guides 15 and 16, and detection signals from the sensor portions 82 and 82 are input to control unit (not illustrated). The control unit detects time at which a front end and a rear end of a sheet S pass from the detection signals from the sensor portions 82 and 82, and determines the length of the sheet S from the time and the conveying speed of the sheet S by the pair of conveying rollers 10 and 11.

The pair of conveying rollers 10 and 11 are disposed between a pair of upstream conveying guides 13 and 14 and a pair of downstream conveying guides 15 and 16. As illustrated in FIG. 4, the conveying roller 10 includes a shaft 10*b* and a plurality of rotating bodies 10*a* provided on the shaft 10*b* at distances from one another in the axial direction. The other conveying roller 11 includes a shaft 11*b* and a plurality of rotating bodies 11*a* provided on the shaft 11*b* at distances from one another in the axial direction. A sheet S is nipped and conveyed by a nip portion N which is pressure contact portions of the pair of rotating bodies 10*a* and 11*a*.

The rotating body 10*a* of the conveying roller 10 is made of metal, the surface of the rotating body 10*a* is subjected to blast processing, and a friction coefficient thereof is enhanced. The conveying roller 10 is a blast roller. The rotating body 11*a* of the other conveying roller 11 is made of rubber and is a rubber roller. The conveying force of a sheet S is enhanced by the conveying roller 10 which is the blast roller and the conveying roller 11 which is the rubber roller, and by conveying a sheet S with high conveying force, the conveying stability of the sheet S is enhanced. Therefore, a front end position and a rear end position of a sheet S which is conveyed by the conveying rollers 10 and 11 are detected by the sensor portions 82 and 82, but since the conveying rollers 10 and 11 restrain the sheet S from slipping, the length of the sheet S in the conveying direction can precisely be measured.

The conveying roller 10 is disposed on the upper side and the conveying roller 11 is disposed on the lower side in the first embodiment.

A sheet S which passed through the fixing portion 48 is given heat and pressure by the fixing portion 48 and is shrunk, and the sheet S is curled by the shrinkage difference between the front and the back of the sheet S, and the sheet is prone to be curled toward the heating roller 48*a* of the fixing portion 48.

Hence, in the first embodiment, the sheet conveying apparatus 49 includes guide members 12 disposed in a space on the side of the pair of rotating bodies 10*a* and 11*a*. As illustrated in FIG. 4, the guide members 12 are formed into thin plate-shape, and disposed on both sides of the rotating bodies 10*a* and 10*a* of the conveying roller 10.

More specifically, as illustrated in FIG. 3, the guide member 12 is formed into a disk shape (annularly shape) having a diameter larger than that of the rotating body 10*a*, the guide member 12 is loosely fitted to the shaft 10*b* which supports the rotating body 10*a* and is rockably supported. That is, a hole 12*a* having a diameter larger than that of the shaft 10*b* is formed in the center of the guide member 12, and the shaft 10*b* is inserted through the hole 12*a*. With this, the guide member 12 can project outward from the outer periphery of the rotating body 10*a* upstream in the sheet conveying direction, and the guide member 12 rocks around the shaft 10*b*, and can retract into the space on the side of the pair of rotating bodies 10*a* and 11*a*. In a state where a sheet S is not conveyed, the guide member 12 projects, by its own weight, to a projecting position where the guide member 12 projects outward from the outer periphery of the rotating body 10*a* upstream in the sheet conveying direction. Further, an end of the guide member 12 projects to a space on the side of the other rotating body 11*a*. That is, the end of the guide member 12 projects toward the lower end than the nip portion N.

A friction coefficient of the guide member 12 is set smaller than those of the rotating bodies 10*a* and 10*b*, and even if a front end of a sheet S hit the guide member 12, the front end is not caught.

The guide member 12 is formed into the disk-like shape, and as illustrated in FIG. 3, a perfect circular shape is preferable, but the shape is not limited to the perfect circular shape, an elliptic shape or distorted circular shape may be employed only if a front end of a sheet S is not caught.

Figure 5:
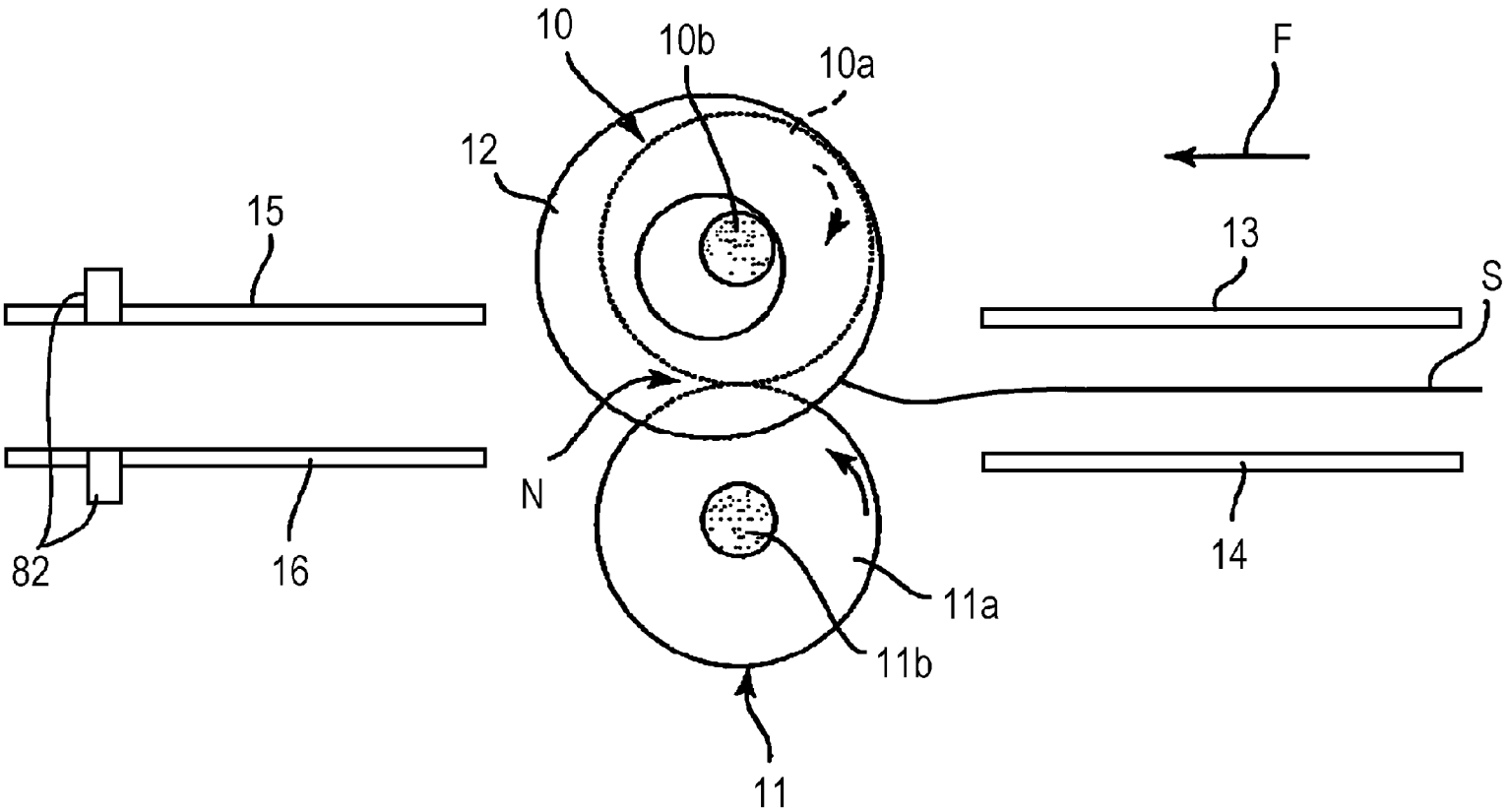
FIG. 5 is an explanatory diagram illustrating a state where a front end of a sheet hits a guide member in the sheet conveying apparatus.
Figure 6:
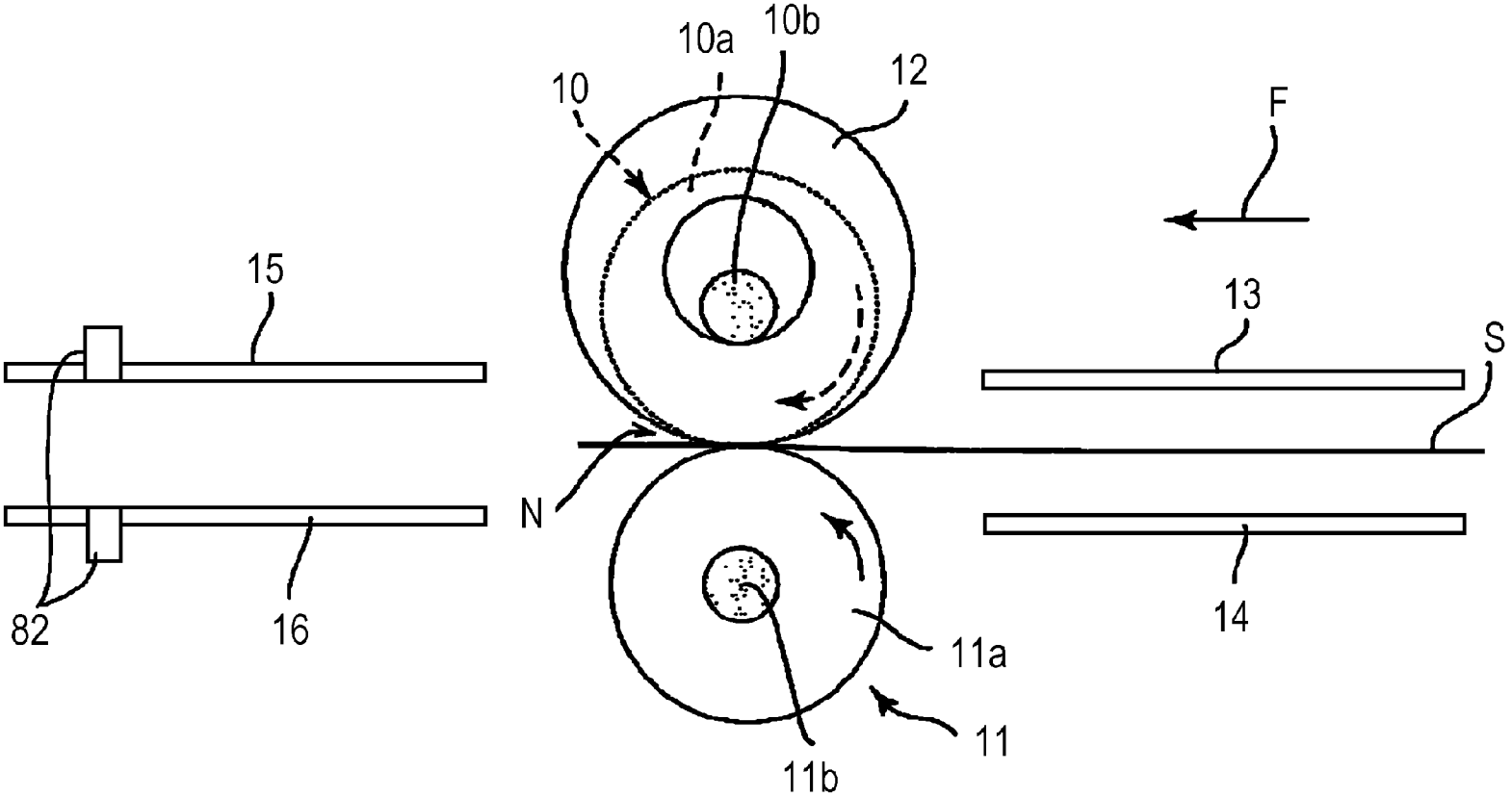
FIG. 6 is an explanatory diagram illustrating a state where a front end of a sheet is guided to a nip portion by the guide member in the sheet conveying apparatus.
Figure 7:
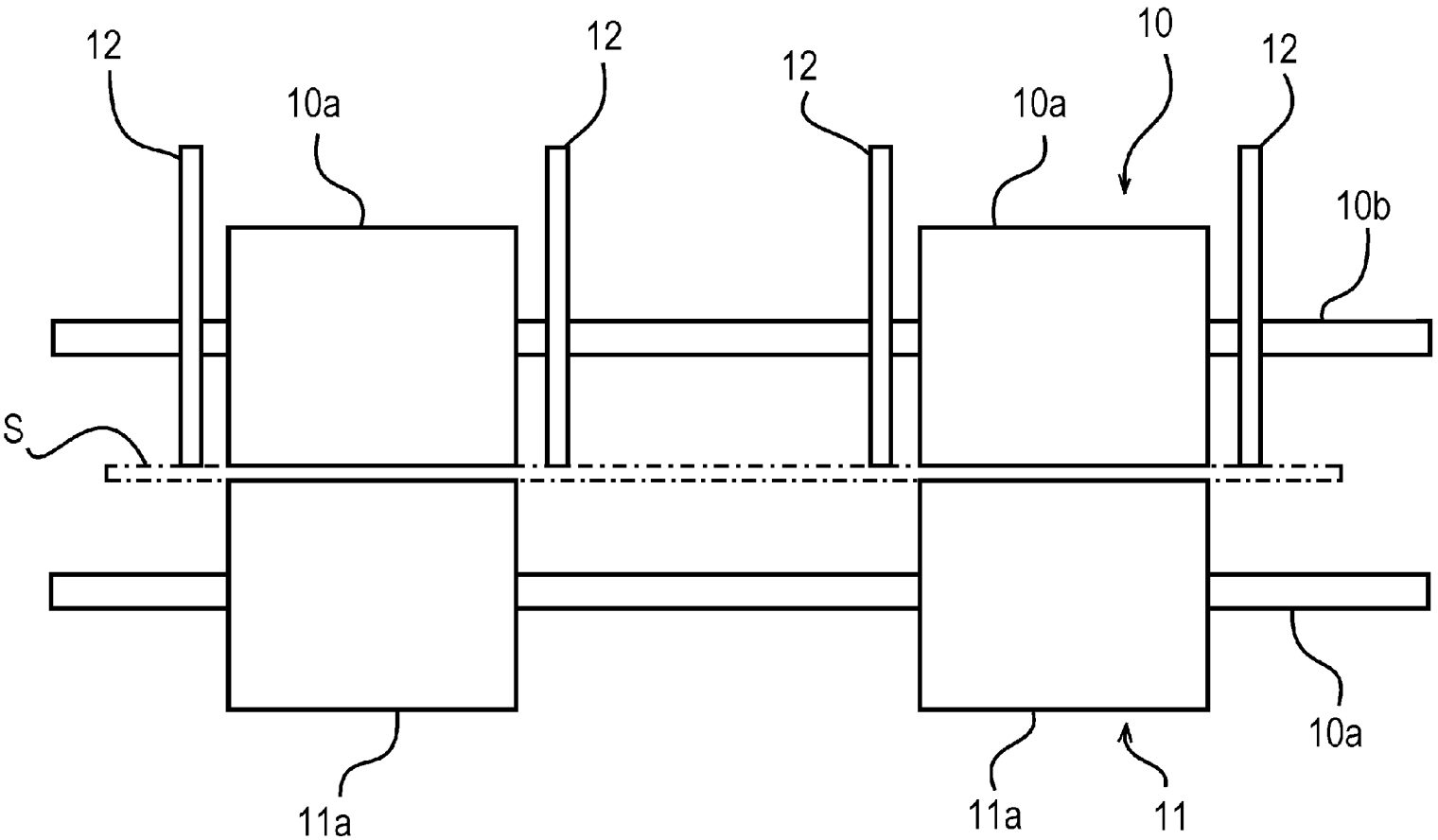
FIG. 7 is an explanatory diagram as viewed from the conveying direction of a sheet in FIG. 6.

Next, the operation of the guide member 12 will be described. FIG. 5 is an explanatory diagram illustrating a state where a front end of a sheet S hits the guide member 12 in the sheet conveying apparatus. FIG. 6 is an explanatory diagram illustrating a state where a front end of a sheet S is guided to a nip portion N by the guide member 12 in the sheet conveying apparatus. FIG. 7 is an explanatory diagram as viewed from the conveying direction of a sheet in FIG. 6.

As illustrated in FIG. 5, a front end of a sheet S conveyed by the pair of conveying rollers 10 and 11 abuts against the guide member 12 before it abuts against the rotating body 10*a* of the conveying roller 10. When the front end of the sheet S abuts against the guide member 12, the guide member 12 is pushed by the front end of the sheet S, the guide member 12 rocks in the sheet conveying direction (direction of the arrow F), and the guide member 12 retracts from the projecting position. If the guide member 12 retracts from the projecting position in this manner, increase of conveying resistance of the sheet S when the sheet S is conveyed to the nip portion N is suppressed, and the sheet S can be conveyed stably. At that time, the front end of the sheet S slides into a lower side of the guide member 12 and is guided to the nip portion N without being caught on the guide member 12 in the peripheral end of the guide member 12 having a small friction coefficient.

Since the guide member 12 is loosely fitted to the shaft 10*b*, the guide member 12 can turn, and when the front end of the sheet S abuts against the guide member 12, the guide member 12 rocks in the sheet conveying direction (direction of the arrow F) and in this state, the guide member 12 turns in the sheet conveying direction. With this, the front end of the sheet S can reliably be guided to the nip portion N.

As illustrated in FIGS. 6 and 7, the guide member 12 retracts upward against the gravity by the rigidity of a sheet S, and retracts from the space on the side of the other rotating body 11*a*.

Since the front end of the sheet S is guided to the nip portion N by the guide member 12, it is possible to prevent the front end of the sheet S from being damaged, i.e., folded, bent or ripped, and the sheet S can stably be conveyed.

At that time, the guide member 12 abuts against the sheet S which is nipped and conveyed by the pair of rotating bodies 10*a* and 11*a*, but since the guide member 12 does not have opposed rotating bodies which nip the sheet S, the guide member 12 merely idles. That is, the guide member 12 does not contribute to conveyance of the sheet S and thus, only the pair of rotating bodies 10*a* and 11*a* convey the sheet S. Therefore, locations having different conveying forces are not alternately generated in the axial direction of the pair of rotating bodies 10*a* and 11*a*, and it is possible to stably convey a sheet S. Since the guide member 12 is rotating, it is possible to prevent the conveying resistance of a sheet S nipped and conveyed from increasing.

Figure 8:
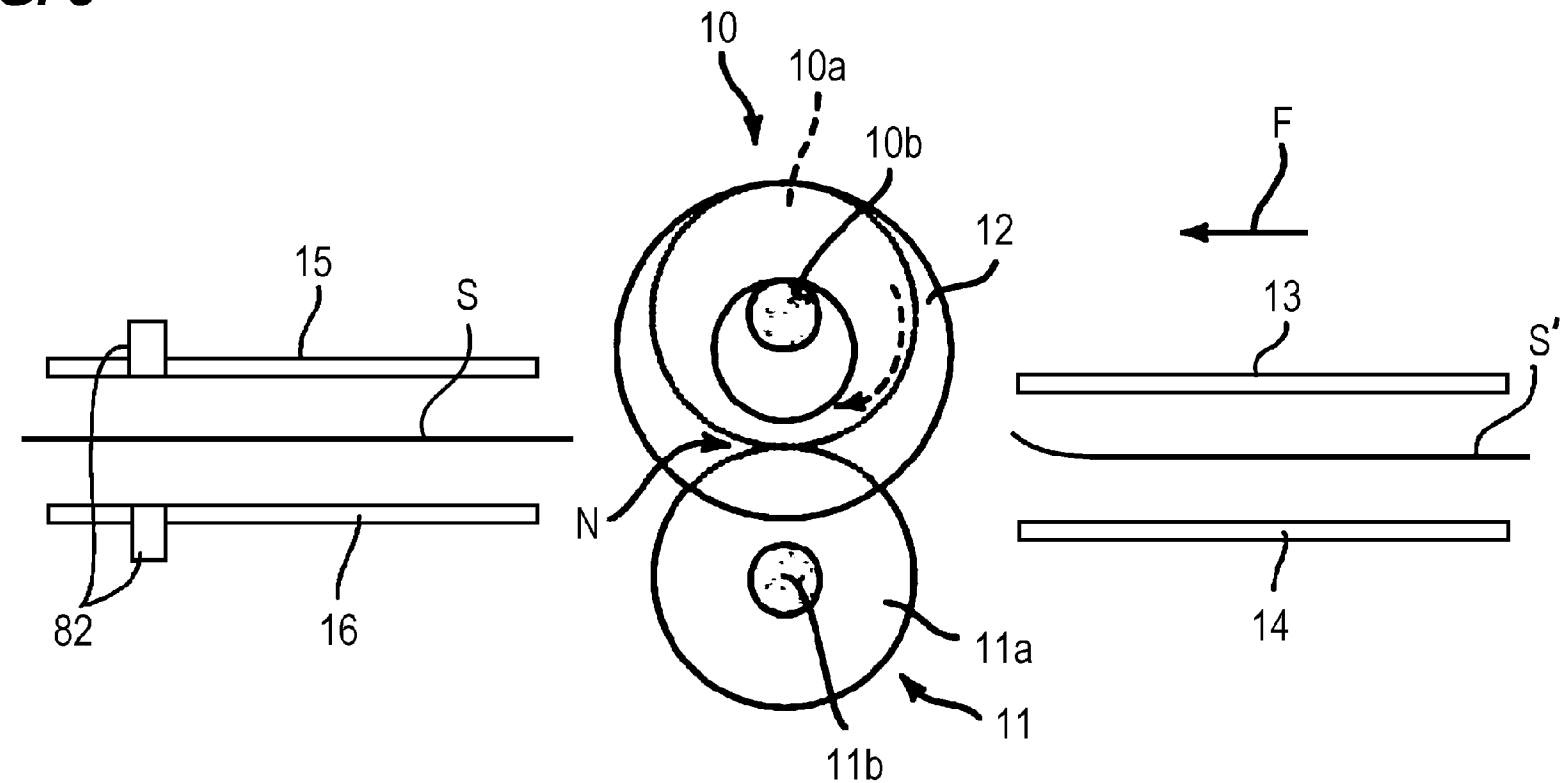
FIG. 8 is an explanatory diagram illustrating a state where a sheet comes out from the nip portion in the sheet conveying apparatus.

FIG. 8 is an explanatory diagram illustrating a state where a sheet S comes out from the nip portion N. As illustrated in FIG. 8, if the sheet S passes through the nip portion N, the guide member 12 moves downward by its own weight, and projects to the projecting position projecting outward from the outer periphery of the rotating body 10*a* upstream in the sheet conveying direction. Since the sheet S is stably conveyed, the length of the sheet S in the sheet conveying direction can precisely be measured by the sensor portions 82 and 82.

Thereafter, the guide member 12 operates in the same manner when a subsequent sheet S' is conveyed, and before the sheet S' comes into contact with the rotating bodies 10*a* and 11*a*, the sheet S' comes into contact with the guide member 12, this prevents the front end of the sheet S' from being folded, bent or ripped, and the sheet S' can be guided to the nip portion N. With this, even when sheets are continuously conveyed, it is possible to prevent a front end of each sheet from being folded, bent or ripped.

[Second Embodiment]

In the first embodiment, the upper conveying roller is provided with the guide member to prevent a front end of a sheet from curling upward. The second embodiment will be described based on a case where the lower conveying roller is provided with the guide member to prevent a front end of a sheet from curling downward. The same structures as those of the first embodiment will be designated with the same symbols, and description thereof will be omitted.

Figure 9:
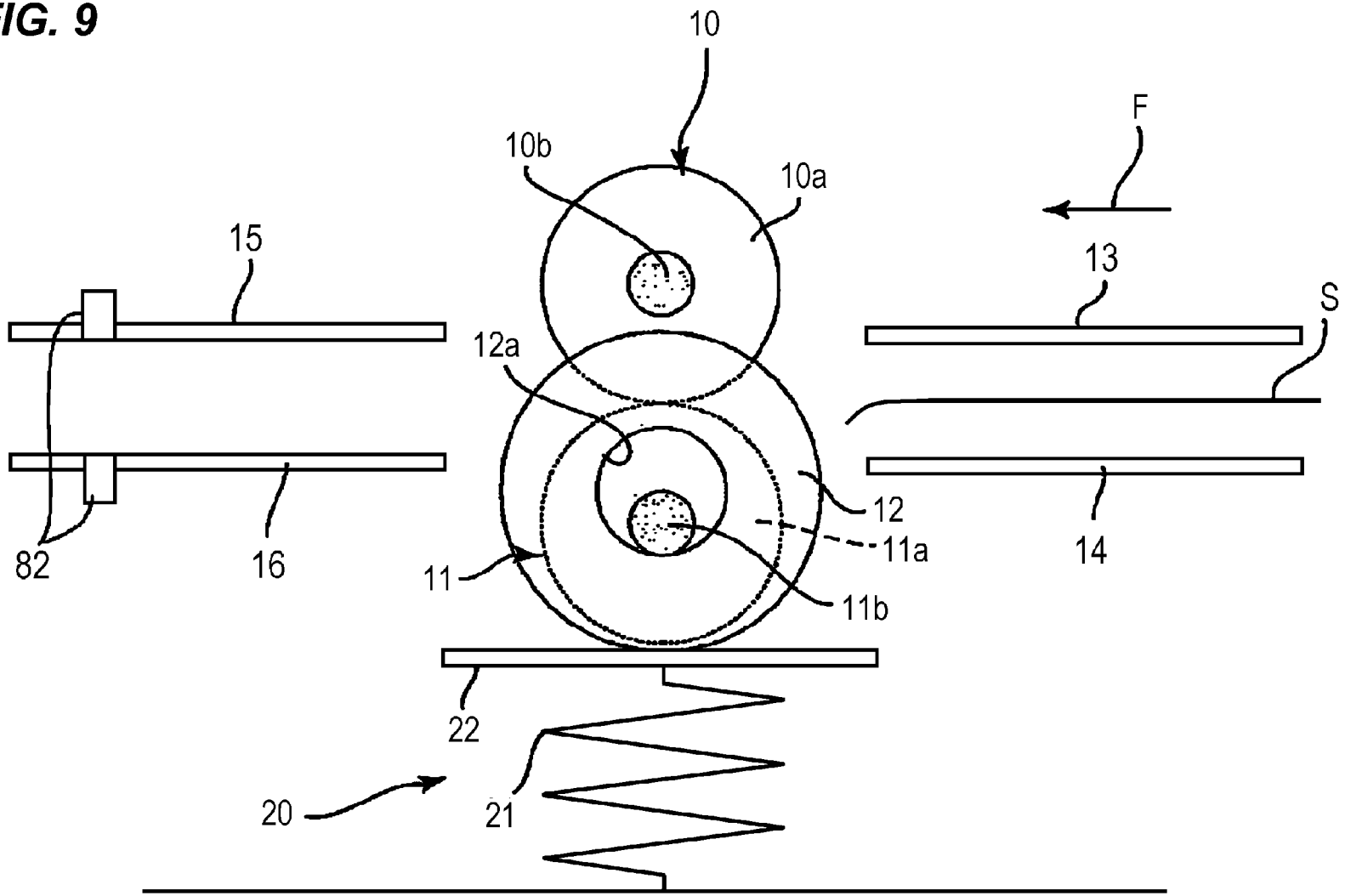
FIG. 9 is an explanatory diagram illustrating an essential portion of a sheet conveying apparatus of a second embodiment.
Figure 10:
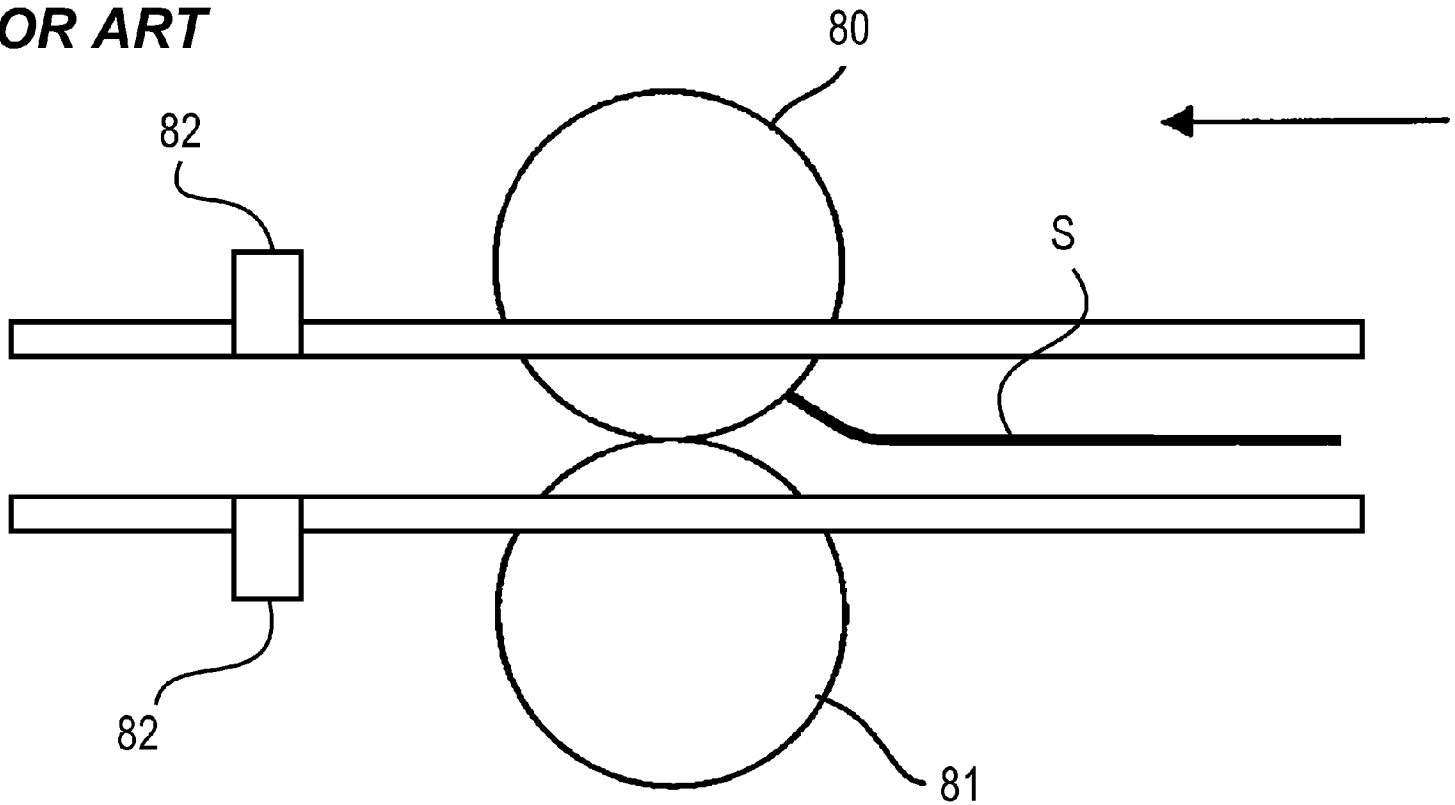
FIG. 10 PRIOR ART
FIG. 10 is a diagram illustrating a sheet conveying apparatus provided downstream of a fixing portion in a conventional image forming apparatus.
Figure 11:
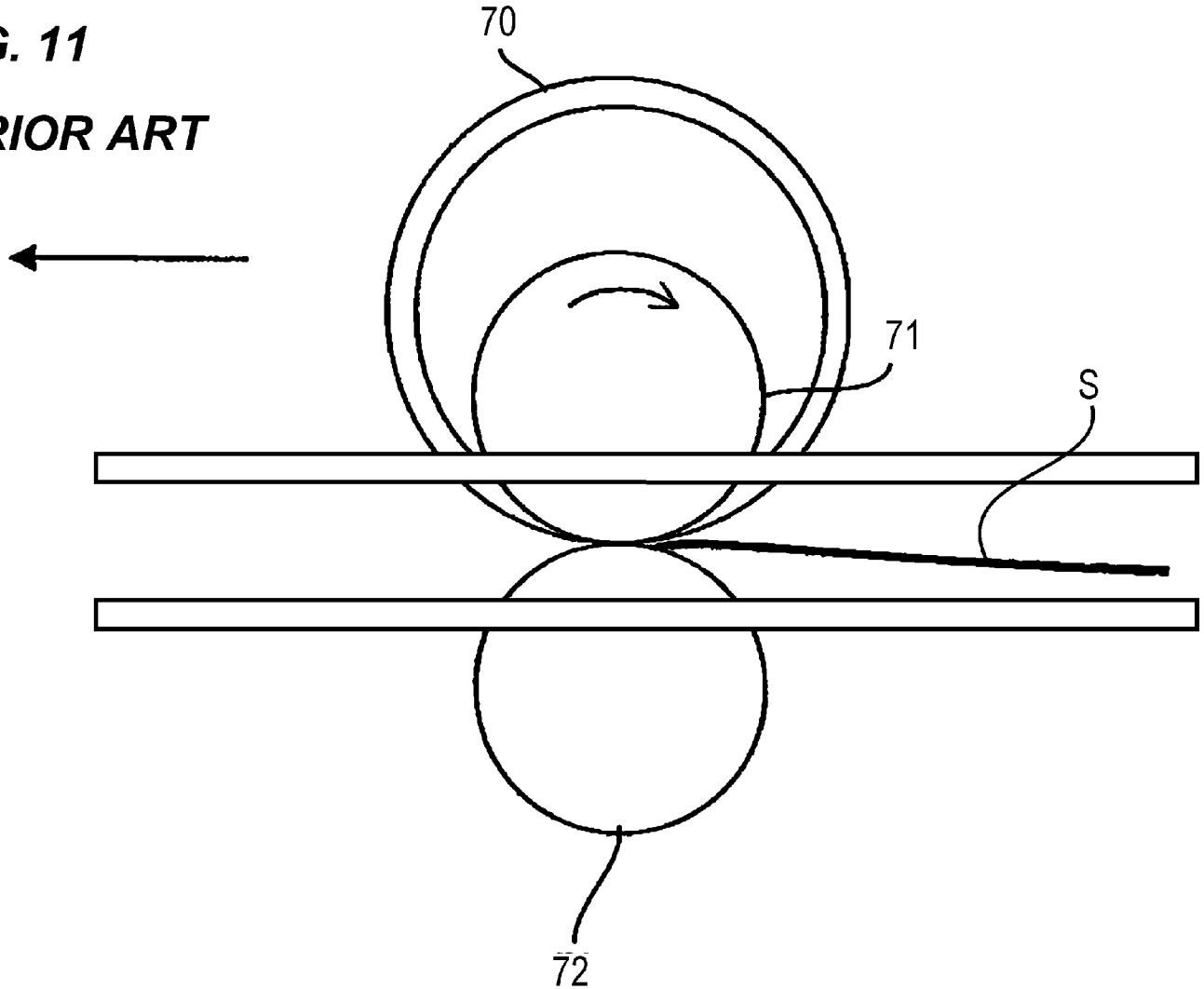
FIG. 11 PRIOR ART
FIG. 11 is a diagram illustrating one example of a pair of conveying rollers provided with a conventional guide member.

FIG. 9 is an explanatory diagram illustrating an essential portion of a sheet conveying apparatus of the second embodiment.

In the second embodiment, a guide member 12 is formed into a disk-like shape having a diameter larger than a rotating body 11*a*, the guide member 12 is loosely fitted to a shaft 11*b* which supports the rotating body 11*a* and is rockably supported. That is, a hole 12*a* having a diameter larger than that of the shaft 11*b* is formed in the center of the guide member 12, and a shaft 11*b* is inserted into the hole 12*a*.

In the second embodiment, the sheet conveying apparatus includes a biasing member 20 which applies a force to the guide member 12 toward the other rotating body 10*a*. The biasing member 20 includes a compression coil spring 21, and a plate material 22 which abuts against the guide member 12, and applies a force to the guide member 12 upward (toward the other rotating body).

With this, the guide member 12 can project outward from an outer periphery of the rotating body 11*a* upstream in the sheet conveying direction (direction of the arrow F), and can rock around the shaft 11*b* and retract into a space on the side of the pair of rotating bodies 10*a* and 11*a* from a projecting position. In a state where a sheet S is not conveyed, the guide member 12 project to the projecting position where it projects outward from the outer periphery of the rotating body 11*a* upstream in the sheet conveying direction by the application force of the biasing member 20. Further, an end of the guide member 12 projects into the space on the side of the other rotating body 10*a*. That is, the end of the guide member 12 projects higher than the nip portion N.

Although it is not illustrated in the drawing, the guide members 12 are formed into thin plate-like shapes and are disposed on both sides of the rotating bodies 11*a* in the conveying roller 11.

A front end of a sheet S conveyed by the pair of conveying rollers 10 and 11 abuts against the guide member 12 before it abuts against the rotating body 11*a* of the conveying roller 11. If the front end of the sheet S abuts against the guide member 12, the guide member 12 is pushed by the front end of the sheet S and rocks in the sheet conveying direction (direction of the arrow F), and retracts from the projecting position. If the guide member 12 retracts from the projecting position, the increase in the conveying resistance of the sheet S conveyed to the nip portion N is suppressed and the sheet S can stably be conveyed. At that time, the front end of the sheet S slides into an upper side of the guide member 12 and is guided by the nip portion N without being caught on the guide member 12 in the peripheral end of the guide member 12 having a small friction coefficient.

Since the guide member 12 is loosely fitted to the shaft 10*b*, the guide member 12 can turn, and when the front end of the sheet S abuts against the guide member 12, the guide member 12 rocks in the sheet conveying direction (direction of the arrow F) and in this state, the guide member 12 turns in the sheet conveying direction. With this, the front end of the sheet S can reliably be guided to the nip portion N.

The guide member 12 retracts upward against the gravity by the rigidity of a sheet S, and retracts from the space on the side of the other rotating body 11*a*.

Since the front end of the sheet S is guided to the nip portion N by the guide member 12, it is possible to prevent the front end of the sheet S from being damaged, i.e., folded, bent or ripped, and the sheet S can stably be conveyed.

Although the present invention has been described based on the first and second embodiments, the invention is not limited to the embodiments.

Although one of the conveying rollers 10 and 11 is provided with the guide member 12 in the embodiments, both the conveying rollers 10 and 11 may be provided with the guide members 12.

Although the conveying roller disposed downstream of the fixing portion 48 in the sheet conveying direction is provided with the guide member 12 in the embodiments, the invention is not limited to this. For example, the re-conveying path R may be provided with a sensor which measures a length of a sheet S, and the sheet conveying apparatus of the embodiment may be provided upstream of the sensor.

In the embodiments, if the guide member is applied to the conveying roller which has an adverse possibility that a front end of a curled sheet may be caught, it is possible to prevent the front end of the sheet from being caught on the rotating body in the conveying roller. With this, it is possible to prevent a front end of a sheet from being damaged, i.e., from being folded, bent or ripped, and the sheet can stably be conveyed.

Although each conveying roller has a plurality of rotating bodies in the embodiments, the invention is not limited to this, and each conveying roller may have one rotating body.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-083854, filed Mar. 27, 2008, which is hereby incorporated by reference herein in its entirety.

What is claimed is:

1. A sheet conveying apparatus comprising:

a plurality of first rotating bodies;

a shaft on which the first rotating bodies are provided;

a plurality of second rotating bodies provided at a lower side of the first rotating bodies, which pressure contact with the first rotating bodies to nip a sheet by a nip portion and to convey the sheet; and a guide member loosely fitted on the shaft and disposed in a space on a side of a pair of rotating bodies of the first rotating bodies and the second rotating bodies, the guide member formed into a disk-like shape having a diameter larger than that of the first rotating bodies and a hole formed in a center of the guide member having a diameter larger than that of the shaft, and the guide member projecting toward the lower than the nip portion of the pair of the rotating bodies in a state where the sheet is not conveyed by the first and second rotating bodies, wherein when a front end of a conveyed sheet abuts against the guide member and pushes the guide member, the guide member retracts from a projecting position into the space on the side of the pair of rotating bodies and guides the front end of the conveyed sheet to the nip portion of the pair of the rotating bodies.

2. The sheet conveying apparatus according to claim 1, wherein the guide member is located at the projecting position by its own weight.

3. The sheet conveying apparatus according to claim 1, wherein the first rotating bodies is made of metal and a surface of the first rotating bodies are subjected to blast processing, and the second rotating bodies is made of rubber.

4. An image forming apparatus has an image forming portion which forms an image on a sheet, the image forming apparatus comprising:

a plurality of first rotating bodies;

a shaft on which the first rotating bodies are provided;

a plurality of second rotating bodies provided at a lower side of the first rotating bodies, which pressure contact with the first rotating bodies to nip a sheet by a nip portion and to convey the sheet; and a guide member loosely fitted on the shaft and disposed in a space on a side of a pair of rotating bodies of the first rotating bodies and the second rotating bodies, the guide member formed into a disk-like shape having a diameter larger than that of the first rotating bodies and a hole formed in a center of the guide member having a diameter larger than that of the shaft, and the guide member projecting toward the lower than the nip portion of the pair of the rotating bodies in a state where the sheet is not conveyed by the first and second rotating bodies, wherein when a front end of a conveyed sheet abuts against the guide member and pushes the guide member, the guide member retracts from a projecting position into the space on the side of the pair of rotating bodies and guides the front end of the conveyed sheet to the nip portion of the pair of the rotating bodies.

5. The image forming apparatus according to claim 4, wherein the guide member is located at the projecting position by its own weight.

6. The image forming apparatus according to claim 4, wherein the first rotating bodies is made of metal and a surface of the first rotating bodies are subjected to blast processing, and the second rotating bodies is made of rubber.

* * * * *